US007478795B2

(12) United States Patent
Grapes et al.

(10) Patent No.: US 7,478,795 B2
(45) Date of Patent: Jan. 20, 2009

(54) MARINE WINCH WITH WINCH-LINE ENGAGING ROLLER

(75) Inventors: David B Grapes, Pittsburgh, PA (US); Russell J Mayhew, Pittsburgh, PA (US)

(73) Assignee: W.W. Patterson Company, Pittsburgh, PA (US)

( * ) Notice: Subject to any disclaimer, the term of this patent is extended or adjusted under 35 U.S.C. 154(b) by 0 days.

(21) Appl. No.: 11/688,974

(22) Filed: Mar. 21, 2007

(65) Prior Publication Data

US 2008/0061277 A1 Mar. 13, 2008

Related U.S. Application Data

(60) Provisional application No. 60/743,603, filed on Mar. 21, 2006.

(51) Int. Cl.
*B66D 1/00* (2006.01)

(52) U.S. Cl. ..... 254/333; 254/383

(58) Field of Classification Search ..... 254/333, 254/371, 374, 383
See application file for complete search history.

(56) References Cited

U.S. PATENT DOCUMENTS

| | | | | |
|---|---|---|---|---|
| 1,984,604 | A | 12/1934 | Stahl | |
| 2,019,511 | A | 11/1935 | Stahl | |
| 2,549,172 | A | 4/1951 | Cline | |
| 3,353,793 | A | 11/1967 | Nelson | |
| 3,836,123 | A | 9/1974 | Bausenbach | |
| 3,841,606 | A * | 10/1974 | Declercq | 254/333 |
| 3,843,094 | A | 10/1974 | Watts | |
| 4,611,688 | A | 9/1986 | Sekhar | |
| 4,721,285 | A | 1/1988 | McMichael | |
| 5,358,190 | A * | 10/1994 | Fladung | 242/388 |
| 5,669,575 | A | 9/1997 | Byle | |
| 6,247,680 | B1 * | 6/2001 | Cohen | 254/333 |
| 6,386,324 | B1 | 5/2002 | Baranda | |
| 6,394,420 | B2 | 5/2002 | Kiviniitty | |
| 6,726,182 | B2 | 4/2004 | Topping, Jr. | |
| 7,104,492 | B1 * | 9/2006 | Massell et al. | 242/397 |
| 2006/0278861 | A1 * | 12/2006 | Leslie | 254/333 |

* cited by examiner

*Primary Examiner*—Emmanuel M Marcelo
(74) *Attorney, Agent, or Firm*—Blynn L. Shideler; Krisanne Shideler; BLK Law Group

(57) ABSTRACT

A manual marine barge winch includes a housing, a winch-line holding drum mounted for rotation on the housing, a winch-line coupled to the drum and adapted to be wound onto and off of the holding drum to tension and pay out the winch, a drum drive for rotating the drum to tension and to pay out the winch line, and at least one winch-line engaging roller adapted to engage the winch line at least during tensioning of the winch. Preferably at least one of the winch line engaging rollers is a powered or driven roller for driving the winch line.

19 Claims, 6 Drawing Sheets

MARINE WINCH WITH WINCH-LINE ENGAGING ROLLER

This application claims the benefit of provisional application Ser. No. 60/743,603 entitled "Marine Winch with Winch-Line Engaging Roller" filed Mar. 21, 2006 and incorporated herein by reference in its entirety.

BACKGROUND OF THE INVENTION

1. Field of the Invention

The present invention relates to a marine winch with a winch-line engaging roller, and more particularly the present invention is directed to a manual marine barge grooved drum winch with a wire rope engaging drive roller.

2. Background Information

The present invention relates to marine winches, such as produced by W. W. Patterson, Inc. of Pittsburgh, Pa. Non-powered marine winches, also called manual winches, are often used in barge environments due to the lack of available power in such environments. The manual winches are secured to the barge boat deck, such as through a pivot connection or through a welding of the winch housing to the deck. These types of manual barge winches require a sturdy, simple construction in order to effectively operate with minimal maintenance in a very harsh environment. The barge winches will typically be used to lash together barge trains for efficient transport along rivers. Barge trains will must be broken down and reassembled for locks and the like during river transport, such that easy winch operation is critical for transport efficiency.

Existing manual barge winches have a housing including a mechanism to secure the winch to the boat deck, such as weld seams or D-ring receiving member. Secured to the housing is a rotating drum. A winch-line, typically a wire rope, is wound onto and off of the drum to tension and to pay out the load on the winch. Winch-lines other than wire ropes have been proposed, including rope, chains, and even webbing in a recent introduction by W. W. Patterson, Inc. Winch lines formed of combinations of line types are also known, however, wire rope remains the most common winch-line to date. The drum is rotated by a manually actuated drum drive. Typically the drum drive includes a drum gear secured to and co-axial with the drum, with a pinion gear engaging and driving the drum gear. The pinion gear will be rotated through a hand wheel and/or a ratchet handle generally accessible by the operator from outside of the housing, typically on the side thereof. A selectively engaged ratchet-pawl tension holding unit is generally provided to hold the tension on the drum. Conventional ratchet-pawl holding unit has a pawl, also called a locking dog, that when the pawl is engaged it will be engaging a gear that is coupled to the drum drive, wherein the gear may be the drum gear, the pinion gear, or a separate tension holding gear. The pawl will allow rotation of the drum in the tensioning direction through a ratcheting action, but, when engaged, it will hold the tension of the drum (i.e. the winch will not payout). The pawl is disengaged to allow for releasing of tension from the drum, known as paying out the winch line. Brakes, such as hand brakes and foot brakes, have also been used to temporarily hold the tension when the locking dog is released for a more controlled payout of tension.

The present invention is primarily directed toward a manual marine barge winch having a grooved drum. A grooved drum in a manual marine barge winch refers to a winch-line drum having a helical groove thereon which receives the winch-line, typically a wire rope, therein. One recent proposal for such grooved drums is a series of spacer rods that extend parallel to the drum and are positioned circumferentially around the drum at a position spaced from the edge of the drum that allows enough space for the wire rope, wherein the spacer rods serve to hold the wire rope generally on the drum and in the drum groove, even when the tension on the winch is released. These proposed wire rope engaging spacers will, however, add another source of friction and wear on the winch-line.

The extremely high tension that the winch-lines are under in use and the danger presented when a winch-line fails makes the implementation of the proposed winch line engaging spacers very problematic. It would be beneficial if the advantages of maintaining the wire rope on the drum provided by the proposed circumferentially spaced winch line engaging spacers could be maintained without increasing friction or wear on the winch line, or at least minimizing the additional friction or wear added to the winch line.

SUMMARY OF THE INVENTION

It is noted that, as used in this specification and the appended claims, the singular forms "a," "an," and "the" include plural referents unless expressly and unequivocally limited to one referent. The term winch in this application refers to an apparatus used for applying a pulling force to an object, with the winch having a drum around which is wound a winch line that is coupled to the object being pulled. The term marine in association with a winch in this application refers to a winch constructed for use on barges (open sea or river), tugs, other boats, docks and marine environments in general. The terms tensioning and payout in association with winch in this application refer to the winding of the winch line onto the drum and unwinding of the winch line off of the drum, respectively. The term manual in association with winch in this application refers to a winch that is non-powered wherein the tensioning and payout of the winch line is performed manually by the operator. The terms "driven" or "powered" in association with a winch-line engaging roller in this application refers to a roller that has a rotation force applied to it outside of the force from the engaged winch-line, and the source for such a powered or driven roller may be through the manual input of the operator. The term powered or driven roller in this application is not, therefore, inconsistent with a manual winch. The terms drive side in association with a winch in the present application refers to the side of the winch from which the power to turn the winch is supplied, e.g. the side with the manual hand wheel in a manual winch. The non-drive side in association with the winch is the side opposite the drive side of the winch. It is, of course possible to have two "drive" sides to a winch, e.g., two hand wheels, but it is not common.

All numerical ranges herein include all numerical values and ranges of all numerical values within the recited numerical ranges. The various embodiments and examples of the present invention as presented herein are understood to be illustrative of the present invention and no restrictive thereof and are non-limiting with respect to the scope of the invention.

According to one non-limiting embodiment of the present invention, the invention provides a manual marine barge winch including a housing, a winch-line holding drum mounted for rotation on the housing, a winch-line coupled to the drum and adapted to be wound onto and off of the holding drum to tension and pay out the winch, a drum drive for rotating the drum to tension and to pay out the winch line, and a winch-line engaging, driven roller adapted to engage and drive the winch line at least during tensioning of the winch.

In one non-limiting embodiment of the present invention housing of the marine winch includes a pair of side plates configured to be welded to or rotationally mounted to a boat deck, wherein the holding drum and winch-line engaging driven roller are mounted to the side plates. Further, the winch line may be, preferably, a wire rope and the winch line holding drum is a grooved drum holding the wire rope. The drum drive may include a drum gear attached to the holding drum and a drive pinion engaging the drum gear and wherein the winch-line engaging roller is coupled to the drive pinion. The winch-line engaging roller may be co-axial with the drive pinion. The drum drive may include a hand wheel for manual rotation. The marine winch may include a tension holding ratchet pawl mechanism coupled to the drum.

The marine winch according to one non-limiting embodiment of the present invention further includes at least a second winch-line engaging, driven roller adapted to engage and drive the winch line at least during tensioning of the winch.

The manual marine winch according to one non-limiting embodiment of the present invention may be summarized as having a housing, a wire rope holding drum mounted for rotation on the housing, a wire rope coupled to the drum and adapted to be wound onto and off of the holding drum to tension and pay out the winch, and a plurality of wire rope engaging rollers coupled to the housing space circumferentially about the drum, wherein each roller is adapted to engage the wire rope at least during tensioning of the winch.

These and other advantages of the present invention will be clarified in the description of the preferred embodiments taken together with the attached figures.

DESCRIPTION OF THE PREFERRED EMBODIMENTS

Figure 1:
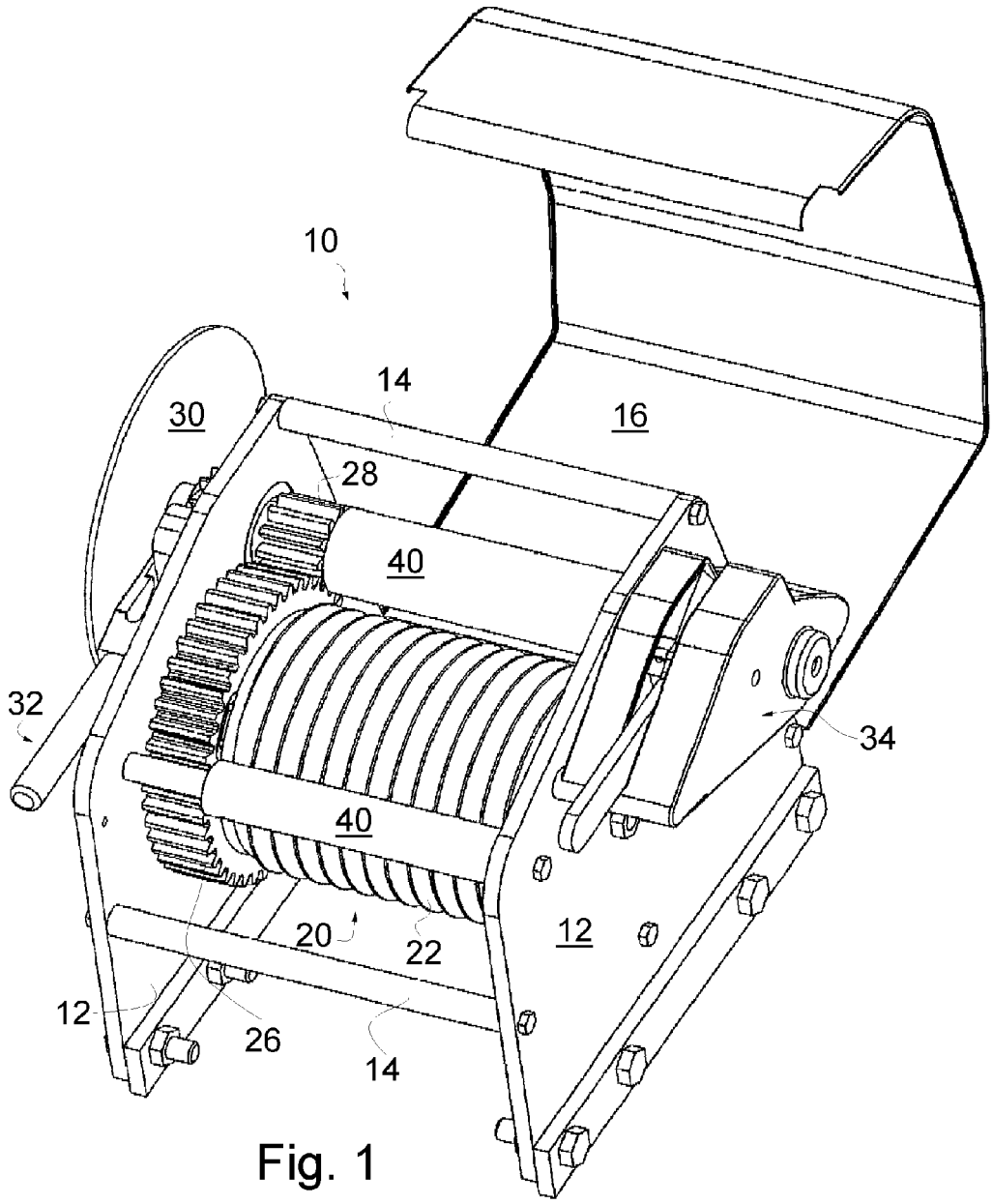
FIG. 1 is a top non-drive side perspective schematic view of a manual marine barge winch with driven wire rope engaging roller according to a first embodiment of the present invention, wherein the housing cover has been pivoted back and the wire rope has been omitted for clarity.

FIG. 1 is a top non-drive side perspective schematic view of a manual marine barge winch 10 according to a first embodiment of the present invention. The winch 10 includes a housing having a pair of side plates 12 that are adapted to be welded down to a boat deck. The winch 10 could also have a D-ring attachment to allow for pivoting of the winch 10, but the weld down version is deemed more appropriate for the particulars of the winch 10. The housing includes a plurality of tie-rod and spacer assemblies 14 extending between the side plates 12 to properly space, hold and support the side plates 12. The tie-rod and spacer assemblies 14 include a tie rod, which is threaded the ends, extending through aligned holes in the opposed side plates 12 with nuts threaded on the ends thereof, or the tie rod may have a bolt head at one end and a threaded nut at only one end. The tie-rod and spacer assemblies 14 further include a spacer on the tie-rod extending between the side plates 12 and sized larger than the aligned holes, wherein the tie-rod and nuts will pull the side plates 12 together while the spacer acts to hold the tie plates the appropriate distance apart. The housing further includes a substantially full cover 16 or cowling. The full cover 16 prevents a substantial amount of debris from entering the interior of the winch 10 and protects the operators from having hands or clothing inadvertently caught in the internal gearing of the winch.

Figure 4:
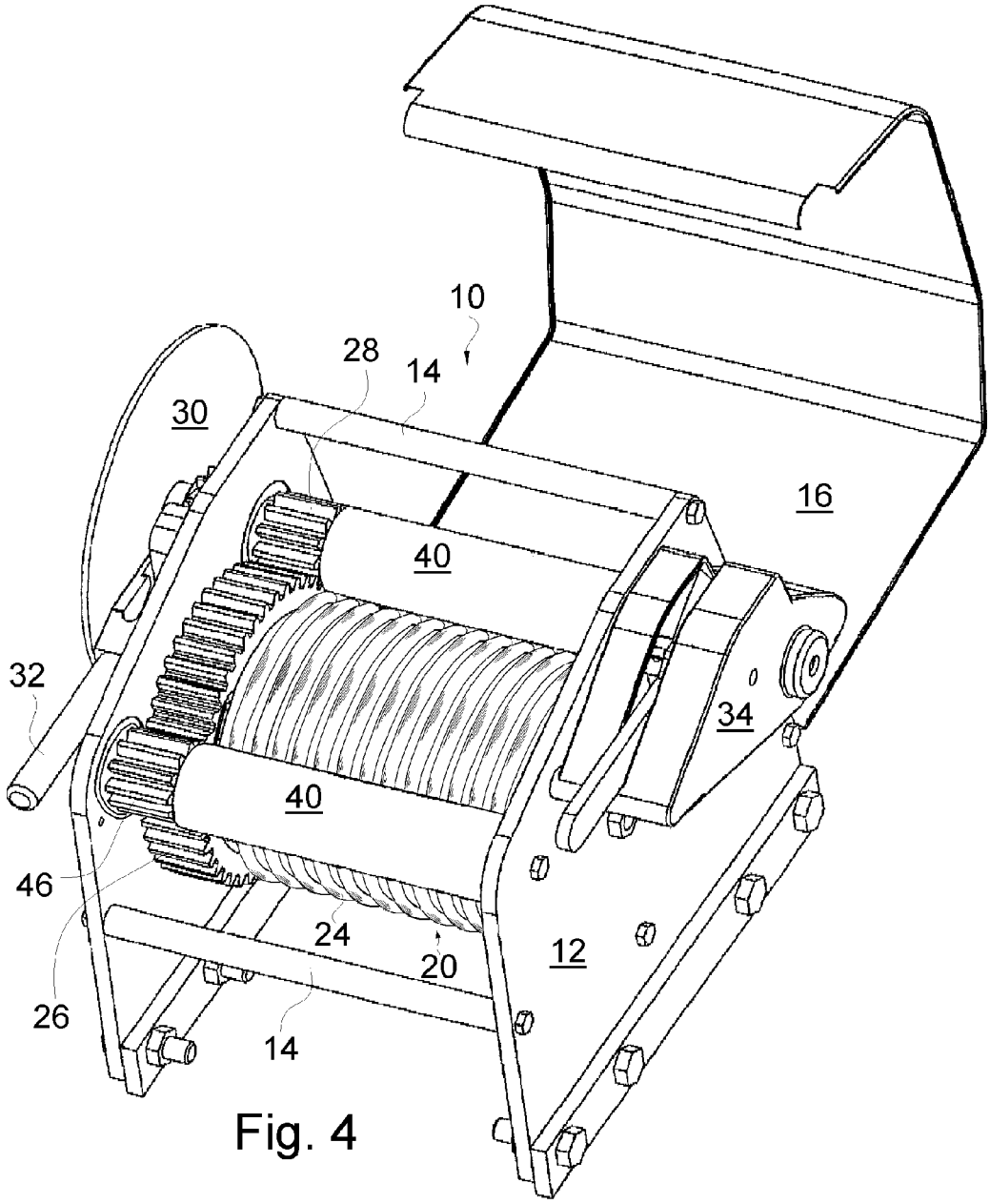
FIG. 4 is a top non-drive side perspective schematic view of the manual marine barge winch of FIG. 3 with a portion of the wire rope schematically illustrated.
Figure 6B:
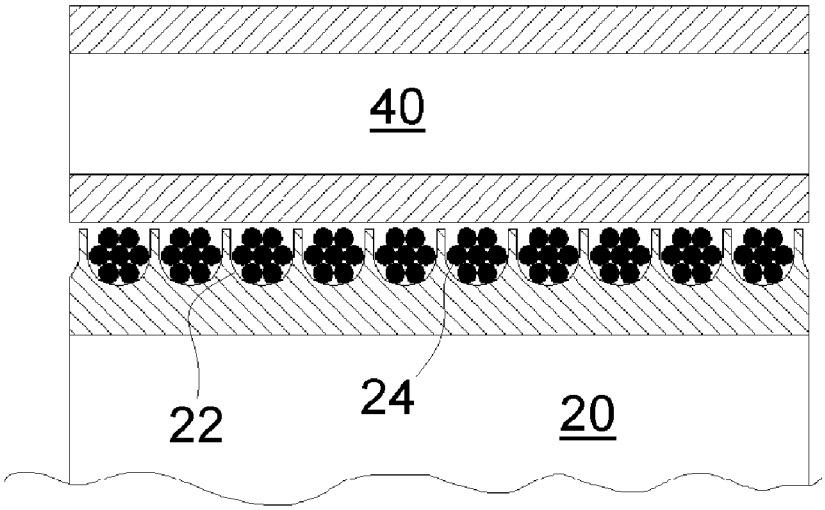
FIGS. 6A and 6B are schematic sectional views of portions of distinct grooved drum designs with the wire rope and associated roller according to the present invention.
Figure 6A:
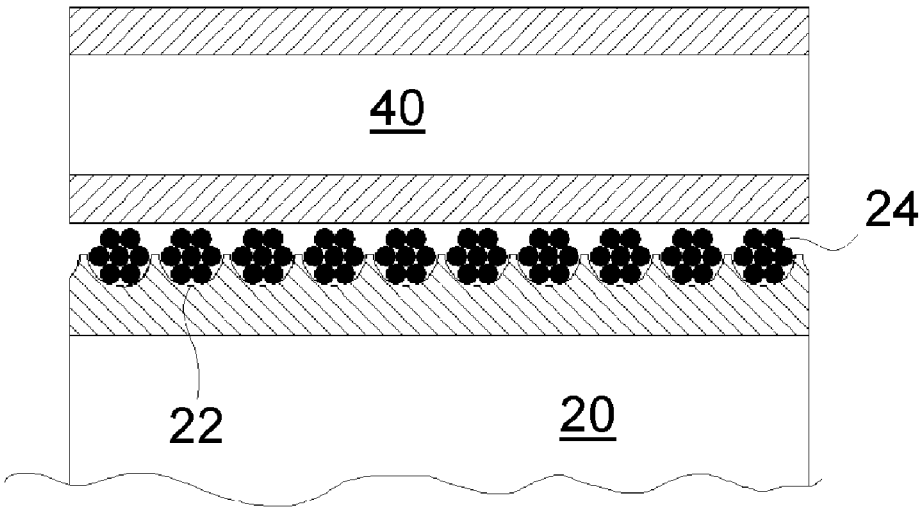

The winch 10 includes a rotating drum 20 secured for rotation to the side plates 12 of the housing. The drum 20 includes a helical groove 22 adapted to receive the winch line, preferably a wire rope 24 as shown in FIG. 4 and FIGS. 6A and B, that is wound onto and off of the drum 20 to tension and to pay out the load on the winch 10. Winch-lines other than a wire rope 24 could be used, such as rope, chains, webbing and combinations thereof, however, wire rope 24, at least at the leading end of the winch line, is generally preferred for reasons discussed below. The leading end of the winch line refers to the portion of the winch line that is wound onto the drum 20. The helical groove 22 need only be sufficiently deep to secure the wire rope 24 therein such as about ⅓ of the diameter of the wire rope 24. FIG. 6A illustrates one embodiment in which the depth of groove 22 is about ½ of the diameter of the wire rope 24. Another embodiment of the drum 20 has the depth of the grooves 22 be substantially equal to the wire rope 24 diameter.

The drum 20 is rotated by a manually actuated drum drive. The drum drive includes a drum gear 26 secured to and co-axial with the drum 20, with a pinion gear 28 engaging and driving the drum gear 26. The pinion gear 28 will be rotated through a hand wheel 30 and/or a ratchet handle unit 32 generally accessible by the operator from the drive side of the winch 10, as shown. The hand wheel 30 is keyed or otherwise attached to the same drive shaft as the pinion gear 28. The ratchet handle unit 32 has a gear keyed or otherwise attached to the drive shaft of the pinion gear 28 and includes a pivoted handle that can pivot into and out of engagement with the gear. When the handle is engaged the movement of the handle will pivot the gear and the pinion gear. The handle is used for final tensioning because it offers an increase lever arm for the user. It is also common for users to add a pipe to the end of the handle to increase the lever arm for the last few tightening movements. A selectively engaged ratchet-pawl tension holding unit 34 is generally provided to hold the tension on the drum 20. The ratchet-pawl holding unit has a pawl, also called a locking dog, that when the unit is engaged will be engaging a locking gear (internal to the locking unit housing in the figures) that is coupled to the drum drive. The locking gear is co-axial with and coupled to the pinion gear 28 such as being keyed to the common drive shaft. The operation of the drum drive and the tension holding unit 34 are conventional in the art of manual barge winches and need not be described further.

A key aspect of the present invention is that the winch 10 includes at least one winch-line engaging roller 40 adapted to engage the winch line. The winch 10 includes a roller 40 that is co-axial with the pinion gear 28 as shown and is keyed or otherwise attached to the common drive shaft, whereby the roller 40 that is coaxial with the pinion gear 28 is a powered or driven roller. There should be an acceptable tolerance between the size of the wire rope 24 and the space between the bottom of the groove 22 and the wire engaging roller 40 as shown in FIGS. 6A and 6B. The tendency of the wire rope 24 to resist bending will actually force the wire rope 24 against the rollers 40. With a drive roller 40 engaging the winch line, the wire rope 24, care should be taken so that the speed that the wire rope 24 is driven by the drive roller 40 is equal to the speed that wire rope 24 is pulled by the drum 20. One method of accomplishing this is to have the diameter of the roller 40 be equal to the pitch circle of the pinion gear 28 and have the diameter of the pitch circle of the drum gear 26 be equal to the diameter of the combination of the drum 20 and one wrap of wire rope 24 thereon. As obvious from a review of FIGS. 6A and B the diameter the combination of the drum 20 and one wrap of wire rope 24 thereon will vary with the depth of the groove 22. For example, in the embodiment shown in FIG. 6B, the outer diameter of the drum is substantially equal to the combination of the drum 20 and one wrap of wire rope 24 thereon, because the grooves 24 have a depth substantially equal to the diameter of the wire rope 24. In the embodiment shown in FIG. 6A, the outer diameter of the drum 20 plus one wire rope diameter is substantially equal to the combination of the drum 20 and one wrap of wire rope 24 thereon, because the grooves 24 have a depth substantially equal to ½ of the diameter of the wire rope 24. This is one relationship between the sizes of the components that will assure that the linear speed that the wire rope 24 is driven by the drive roller 40 is equal to the linear speed that wire rope 24 is pulled by the drum 20. Other relative sized are believed to be possible, but the above described and illustrated solution is relatively straight forward and simple. The reason for this matching of the speeds imparted to the wire rope 24 is critical is that a significant discrepancy between these speeds will increase friction or tension on the wire rope 24, which is what the present invention is intending to avoid. The driven or powered roller 40 will serve to actually drive the wire rope 24 and assist in the tensioning and/or the payout of the wire rope 24.

Figure 2:
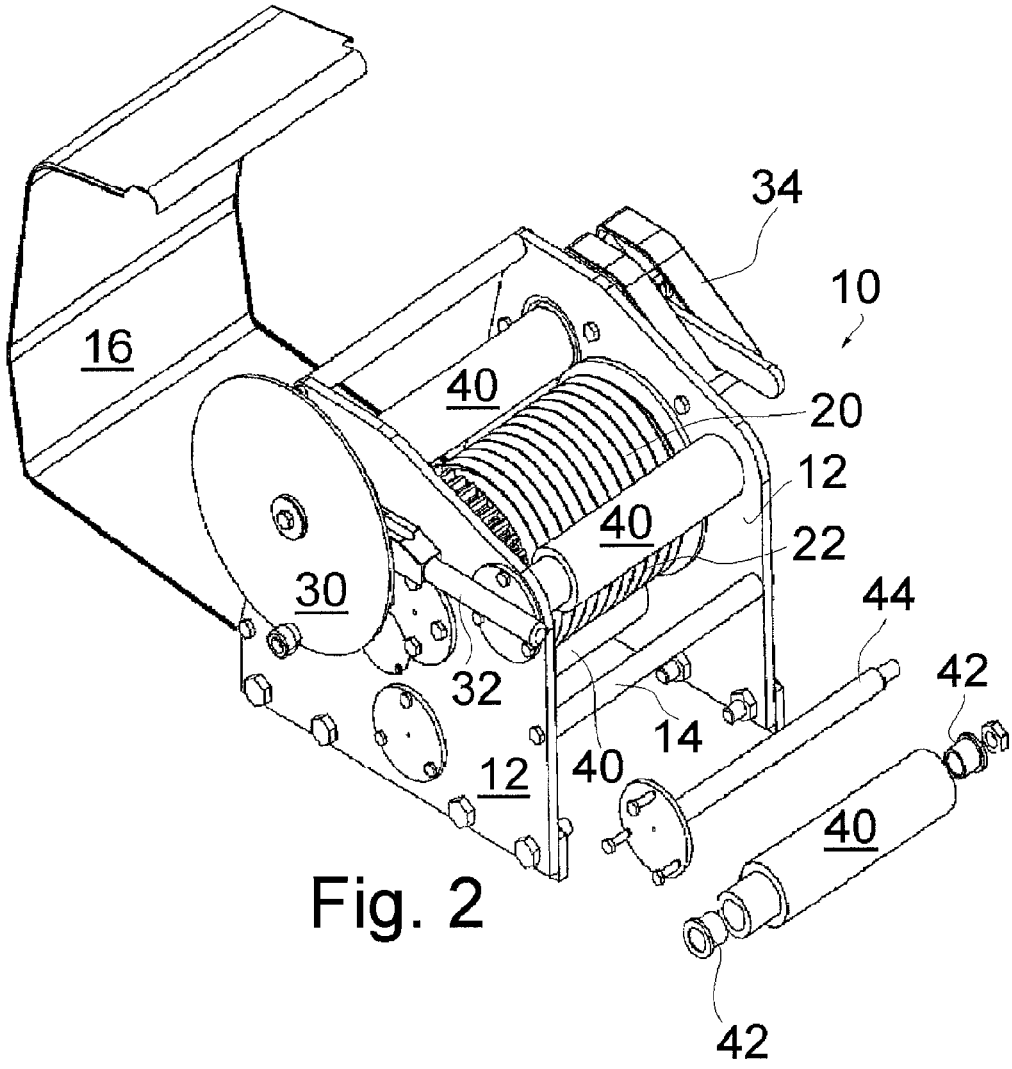
FIG. 2 is a top drive side perspective schematic view of the winch of FIG. 1 with an exploded view of a rope engaging roller.

The winch 10 includes a number of rollers 40 circumferentially spaced about the drum 20, as shown. The illustrated embodiment includes three rollers 40, which is believed to be optimum, but other numbers are also possible. FIG. 2 illustrates an exploded view of the mounting structure for a roller 40, other than the roller 40 that is co-axial with the pinion gear 28 as described below. Each roller 40 is mounted on bearings 42 that are received on a tie bar 44 extending between the side plates 12. One end of the roller 40 is shown as reduced, and this end is on the side of the drum gear 20.

Figure 3:
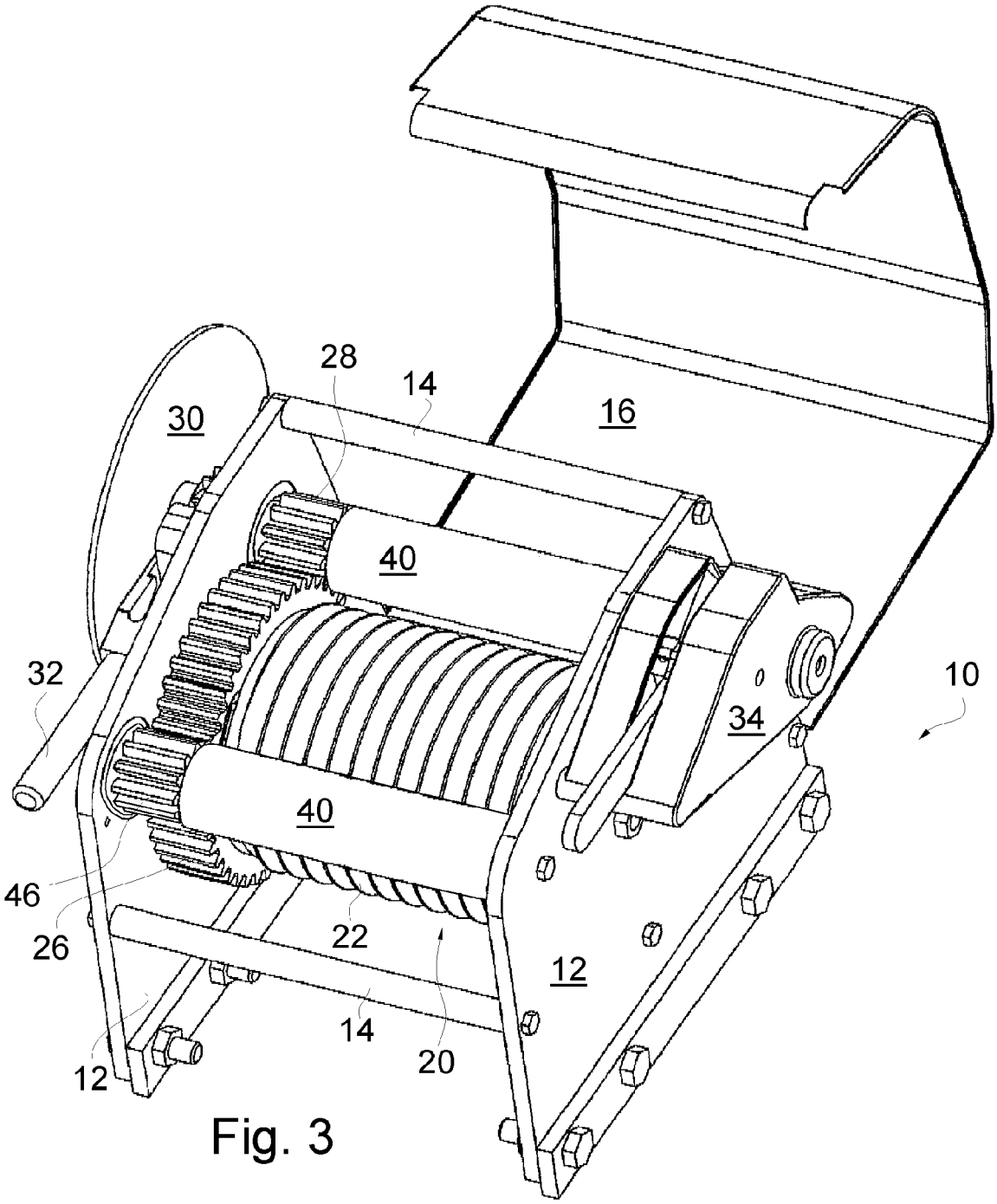
FIG. 3 is a top non-drive side perspective schematic view of a manual marine barge winch with a plurality of driven wire rope engaging rollers according to a second embodiment of the present invention, wherein the housing cover has been pivoted back and the wire rope has been omitted for clarity.

The reduced end of the roller 40 can receive a gear 46 that is keyed or otherwise attached to the roller 40, as shown in FIG. 3. The gear 46 engages the drum gear 20 and forms a powered or driven roller 40. The gear 46 differs from pinion gear 28 in that the pinion gear 28 is driving the drum gear 20, whereas the gear 46 is driven by the drum gear 40. The roller 40 that is co-axial with the pinion gear 40 differs from the other roller constructions in that is mounted and keyed (or otherwise coupled to) the common drive shaft that receives power from the hand wheel 30 or handle unit 32, such that the bearings 42 and tie bar 44 are not required for this mounting.

Without the gear 46 or being mounted on and coupled to the pinion gear 28, the roller 40 is a non-driven roller. One advantage of non-driven rollers 40 is that there is no necessity to match the "drive" speed of the non-driven roller 40 with the drum 20 as there is no "drive" speed. The non-driven rollers 40 will be rotated by the engaged wire rope 24. Non-driven rollers 40 can be of any diameter that is desired. The design concern with non-driven rollers 40 is to minimize the drag or friction imparted which will essentially come from the bearings 42. Non-driven rollers 40 do not have the ability to drive the wire rope 24, however, these are believed to be a substantial improvement over a stationary bar.

Figure 5:
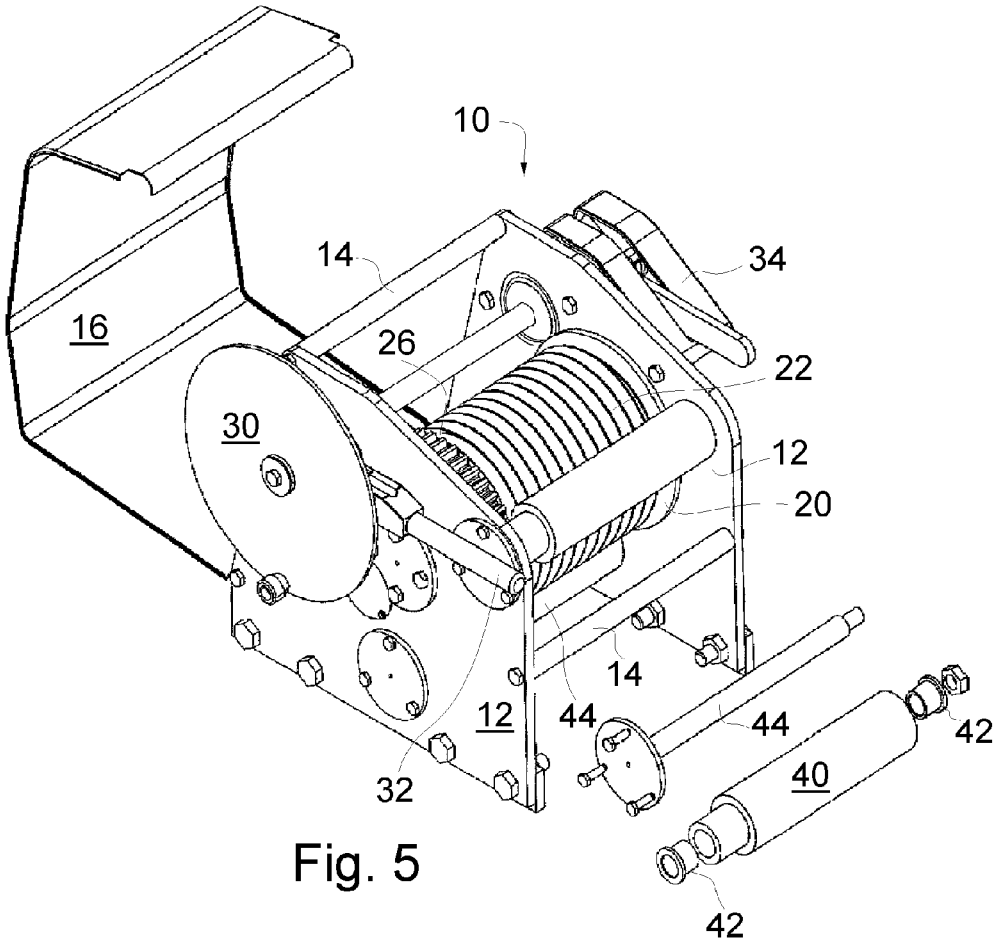
FIG. 5 a top drive side perspective schematic view of a manual marine barge winch with wire rope engaging rollers according to a third embodiment of the present invention, wherein the housing cover has been pivoted back and the wire rope has been omitted for clarity.

The winch 10 shown in FIG. 1 has at least one drive roller 40 that is co-axial with the pinion gear 28, and the two remaining rollers 40 may be powered through the inclusion of the gear 46 or non-driven through the omission of the gear 46. FIGS. 1 and 2 illustrate that at least one of these remaining rollers 40 is non-driven. FIGS. 3 and 4 illustrate the winch wherein at least two of the rollers 40 are driven (note gear 46), although all three may be drive or driven rollers 40. FIG. 5 illustrates an embodiment in which all of the rollers 40 may be non-driven, wherein the roller 40 co-axial with the pinion gear 28 has been removed. Again, the non-drive rollers are believed to be far superior in operation than a stationary bar, but the preferred embodiments of the present invention will have at least one drive roller 40 to drive the wire rope 24.

It is contemplated that the rollers 40, driven or not, could be constructed to be selectively engaged with the wire rope 24 on the drum 20 through a pivoting or sliding arrangement that will move them into and out of (e.g. in a radial direction toward and away from the drum 20) engagement. In such a construction it is preferred that the rollers 40 are engaged at least during tensioning of the winch 10. This arrangement would add considerable added complexity to the overall design and is therefore not a preferred implementation of the present invention.

It should be understood by those having ordinary skill in the art that the present invention is designed for a single wrap of wire rope 24 extending across the grooved drum 20. Consequently the total tension and payout amount of the winch 20 is effectively defined by the linear length of the groove 22 of the drum. The present invention could, in theory, be implemented upon winches that have multiple layers of wire rope on the drum 20, however the rollers 40 would need to move or float with the increase in diameter due to stacking wraps of wire rope 24 and if the rollers were powered or driven then the speed of the driven rollers at the new diameter would need to be adjusted accordingly. This complex implementation of the present invention does not seem to be the most economical implementation of the present invention.

Whereas particular embodiments of this invention have been described above for purposes of illustration, it will be evident to those skilled in the art that numerous variations of the details of the present invention may be made without departing from the invention as defined in the appended claims. The present invention is not intended to be restricted to the particular embodiments disclosed but defined by the appending claims and equivalents thereto.

What is claimed is:

1. A manual marine winch comprising:

a housing;

a winch-line holding drum mounted for rotation on the housing;

a winch-line coupled to the drum and adapted to be wound onto and off of the holding drum to tension and pay out the winch;

a drum drive for manually rotating the drum to tension and to pay out the winch line, wherein the drum drive includes a drum gear attached to the holding drum and a drive pinion engaging the drum gear and a manual rotation input mechanism coupled to the housing for selective operation by the user, wherein manual operation of the manual rotation input mechanism rotates the drum gear through the drive pinion;

a first winch-line engaging, driven roller adapted to engage and drive the winch line at least during tensioning of the winch wherein the winch-line engaging roller is coupled to and coaxial with the drive pinion;

a second winch-line engaging, driven roller spaced circumferentially along the drum from the first winch-line engaging, driven roller and adapted to engage and drive the winch line at least during tensioning of the winch; and a driven gear co-axial with the second winch-line engaging, driven roller spaced circumferentially along the drum gear from the drive pinion.

2. The marine winch of claim 1 wherein the housing comprises a pair of side plates and the holding drum and winch-line engaging driven roller are mounted to the side plates, and a third winch-line engaging, driven roller sraced circumferentially along the drum from the first and second winch-line engaging, driven rollers and adapted to engage and drive the winch line at least during tensioning of the winch.

3. The marine winch of claim 2 wherein the winch line is a wire rope and the winch line holding drum is a grooved drum holding the wire rope.

4. The marine winch of claim 3 wherein the manual rotation input mechanism of the drum drive includes a hand wheel for manual rotation.

5. The marine winch of claim 1 wherein the winch line is a wire rope and the winch line holding drum is a grooved drum holding the wire rope.

6. The marine winch of claim 1 further including at least a second wire rope engaging, driven roller adapted to engage and drive the wire rope at least during tensioning of the winch.

7. A marine winch comprising:

a housing;

a winch-line holding drum mounted for rotation on the housing;

a winch-line coupled to the drum and adapted to be wound onto and off of the holding drum to tension and pay out the winch;

a drum drive for rotating the drum to tension and to pay out the winch line, wherein the drum drive includes a hand wheel for manual rotation;

a winch-line engaging, driven roller adapted to engage and drive the winch line at least during tensioning of the winch, and further including a tension holding ratchet pawl mechanism coupled to the drum.

8. The marine winch of claim 7 wherein the drum drive includes a drum gear attached to the holding drum and a drive pinion engaging the drum gear and wherein the winch-line engaging roller is coupled to the drive pinion.

9. The marine winch of claim 7 wherein the drum drive includes a drum gear attached to the holding drum and a drive pinion engaging the drum gear and wherein the winch-line engaging roller is co-axial with the drive pinion.

10. The marine winch of claim 9 wherein the housing comprises a pair of side plates and the holding drum, the drum drive and winch-line engaging driven roller are mounted to the side plates.

11. The marine winch of claim 7 further including at least a second winch-line engaging, driven roller adapted to engage and drive the winch line at least during tensioning of the winch.

12. A manual marine winch comprising a housing;

a wire rope holding drum mounted for rotation on the housing;

a wire rope coupled to the drum and adapted to be wound onto and off of the holding drum to tension and pay out the winch;

a drum gear coupled to the drum to rotate the drum;

a wire rope engaging, driven roller adapted to engage and drive the wire rope at least during tensioning of the winch; and a common manual drive source for the drum gear and the driven roller.

13. The manual marine winch of claim 12 wherein the housing comprises a pair of side plates and the holding drum and winch-line engaging driven roller are mounted to the side plates.

14. The manual marine winch of claim 12 further including a drive pinion engaging the drum gear coupled to the common manual drive source and wherein the driven wire rope engaging roller is coupled to the drive pinion.

15. The manual marine winch of claim 12 further including a drive pinion engaging the drum gear coupled to the common manual drive source and wherein the driven wire rope engaging roller is co-axial with the drive pinion.

16. The manual marine winch of claim 15 wherein the housing comprises a pair of side plates and the holding drum, the drum drive and wire rope engaging driven roller are mounted to the side plates.

17. The manual marine winch of claim 16 wherein the holding drum is a grooved drum holding the wire rope.

18. The manual marine winch of claim 17 wherein the common manual drive source includes a hand wheel for manual rotation.

19. The manual marine winch of claim 18 further including a tension holding ratchet pawl mechanism coupled to the drum.

* * * * *